United States Patent [19]

Campbell

[11] 4,264,045

[45] Apr. 28, 1981

[54] DESPINNING METHOD AND APPARATUS

[75] Inventor: Robert J. Campbell, Salem, N.H.

[73] Assignee: Avco Corporation, Wilmington, Mass.

[21] Appl. No.: 71,824

[22] Filed: Sep. 4, 1979

[51] Int. Cl.[3] ..... B64G 11/24

[52] U.S. Cl. ..... 244/164; 102/69; 102/92.3; 124/6; 124/41 R

[58] Field of Search ..... 244/1 R, 137 R, 136, 244/158, 164, 167, 165; 102/7.2, 3, 69, 92.3, 92.4; 124/4–6, 8, 80–81, 35 R, 41 R

[56] References Cited

U.S. PATENT DOCUMENTS

| | | | |
|---|---|---|---|
| 2,348,240 | 5/1944 | Braun | 102/7.2 |
| 3,030,049 | 4/1962 | Pilkington | 244/167 |
| 3,128,845 | 4/1964 | Parker | 244/158 |
| 3,229,930 | 1/1966 | Fedor et al. | 244/167 |
| 3,286,630 | 11/1966 | Salmirs et al. | 244/167 |
| 3,380,687 | 4/1968 | Wrench et al. | 244/158 |
| 3,532,296 | 10/1970 | Swet | 244/158 |
| 3,818,833 | 6/1974 | Thoner | 102/7.2 |

FOREIGN PATENT DOCUMENTS

| | | | |
|---|---|---|---|
| 52-39300 | 3/1977 | Japan | 244/158 |
| 5415 | of 1896 | United Kingdom | 124/5 |
| 469153 | 7/1937 | United Kingdom | 102/7.2 |

*Primary Examiner*—Galen Barefoot

*Attorney, Agent, or Firm*—Abraham Ogman

[57] ABSTRACT

In a method for changing the spin of bodies released from an aggregate, the bodies are connected by straps or bars which serve as tension or compression members. Spin of the connected bodies results in either compressive or tensile forces in the connecting member. Those forces in turn provide torque which counters or enhances the spin and converts that spin to or from translational energy. Once the spin of the bodies has been changed a predetermined amount, the connecting member is released.

18 Claims, 23 Drawing Figures

DESPINNING METHOD AND APPARATUS

TECHNICAL FIELD

This invention relates to a method and apparatus for changing the spin of bodies which have been released from a spinning aggregate. It has particular application to such bodies which have been dropped together from an airplane or separate from a spacecraft.

BACKGROUND ART

It is common practice to drop bombs joined together as an aggregate and to then release the individual bombs from that aggregate. In order to provide translational movement of individual bombs relative to each other, the aggregate is set spinning as it is dropped so that when the bombs are released they spin off from each other. A disadvantage of such a system is that, although translational movement is imparted to the individual bombs, each continues to spin at the angular velocity of the aggregate. The primary object of this invention is to provide a means for de-spinning such bombs once they have been released.

The bombs noted above may be explosive or incendiary devices, or they may carry fire extinguishing material or the like. The invention has further application to groups to satellites which may be similarly released. A key advantage to the invention is that it provides a passive means for de-spinning a number of independently functional bodies without the requirement of substantial additional masses such as used in the satellite de-spinning systems shown in the U.S. Pat. No. 3,030,049 to Pilkington et al. and U.S. Pat. No. 3,229,930 to Fedor et al. Further, although total de-spinning of individual bodies is possible, proper design of the passive system enables any degree of change to the spin.

DISCLOSURE OF THE INVENTION

In accordance with the invention the individual spins of at least two bodies released from a spinning aggregate are changed by connecting the bodies with a connection means which, once the bodies are released from the aggregate, provides torque to each body. The torque results from the restriction of the relative spins and/or translational velocities of the bodies by the connecting device. Once the spins have been changed, the bodies are disconnected.

In the primary embodiment of the invention, the connecting means is elongated and flexible and is wrapped about each of the bodies to oppose the spin of the other. More than two bodies may be joined in such a way that torque is applied to each.

The invention has particular applicability to de-spinning of independently functional bodies. By varying the connecting details and geometry of the bodies it is possible to spin all bodies to zero, to reduce the spin to rates other than zero, to increase the spin rate of some or all, or to reverse the direction of spin of the bodies, essentially limited only by the requirements that energy and momentum be conserved in all cases.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principals of the invention.

BEST MODE OF CARRYING OUT THE INVENTION

Figure 1:
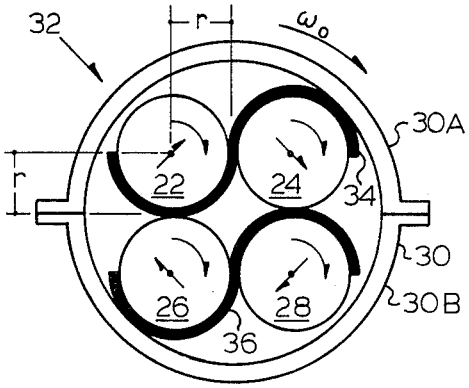
FIG. 1 is an illustration of a spinning aggregate which includes four canisters, the canisters being connected in pairs by straps.

In FIG. 1, four canisters 22, 24, 26 and 28 are held by a holding means 30 and an aggregate 32. As noted above, the canisters may be bombs, satellites or the like. The holding means 30 is shown as a much larger canister which may be separated into sections 30A and 30B by an explosive charge or the like. The holding means 30 might also be a strap or any other suitable structure for releasably holding the several canisters together during the initial spinning.

In the embodiment of FIG. 1, the canisters are grouped in pairs with canisters 22 and 24 joined by a strap 34 and canisters 26 and 28 joined by a strap 36.

Figure 2:
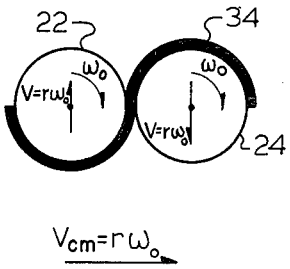
FIG. 2 is an illustration of one pair of the canisters of FIG. 1 at the instant they are released from the aggregate.

With the aggregate spinning at an angular velocity $\omega_o$ it can be seen that each individual canister has the same angular velocity $\omega_o$ about its own center as well as an instantaneous translational velocity tangential to the aggregate. At the instant that the holding means 30 is released, each pair of canisters can be looked at separately as in FIG. 2. Together, the canisters 22 and 24 have a horizontal translational velocity of $$V_{cm}=r\omega_o$$

where r is the radius from the center of the aggregate to the center of the canister pair. The pair is also spinning at the angular velocity of $\omega_o$, and that spinning results in translational components for the individual bodies, relative to the center of mass, as indicated in the figure. Finally, each individual body has an angular velocity relative to its own center of $\omega_o$.

Figure 3:
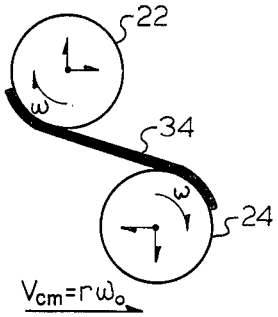
FIG. 3 is an illustration of the two canisters in FIG. 2 as they separate from each other.

Without a connecting strap 34, the four bodies would spin off in orthogonal directions when the holding means 30 is released. However, as shown in FIG. 3, as the bodies being to separate the spinning action of each works against that of the other through the strap. For example, the spinning of bodies 22 and 24 are in opposition through strap 34 so that each body applies a torque to the other through the strap. Torque is also applied as a result of the opposite translational movement of the bodies. The torque applied to each body is opposite to its spin. The spin in the bodies is thus converted to translational movement due to the conservation of energy and momentum. The change in the translational velocity components is indicated through FIG. 4.

Figure 5:
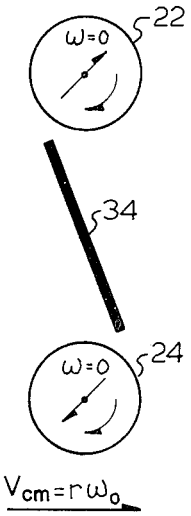
FIG. 5 is an illustration of the two bodies after being disconnected.

With the strap pulling against the two bodies, the angular velocity of each is quickly pulled to zero. At that point, if the bodies remained connected, a reverse spin would be applied to each body. But if the bodies are disconnected at the instant that the angular velocity is zero, the individual bodies continue on their separate paths as shown in FIG. 5, all spin kinetic energy having been converted to translational kinetic energy. In the case shown in FIG. 5, the bodies are disconnected by disconnecting the strap from each canister, but the strap could be disconnected at a single point any where along its length.

Figure 4:
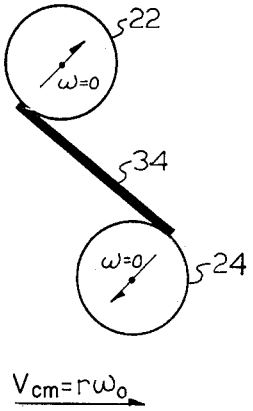
FIG. 4 is an illustration of the canisters of FIGS. 2 and 3 at the instant that the strap is released from the bodies to disconnect them.

The final spin of the bodies, once they have been disconnected, is dependent on many variables. Those variables include the initial spin of the bodies, the effective length of the connecting strap at the release point, the angle between the strap and the body at the time of release, the effective radius at which the strap acts on each body, and the mass properties of each body. By taking some of the parameters as given and others as desired results, still others can be calculated to give the desired results. For example, for two identical canisters, a length of strap can be determined to provide zero spin with tangential release as shown in FIG. 4. That length is equal to $$L=(l+k)^{\frac{1}{2}}r$$

where k is a constant for the particular canisters defined by $$k=I/mr^2$$

where I is the moment of inertia of the object, m is its mass, and r is its effective radius.

The two bodies will usually have the same order of mass and inertia. Where the moment of inertia of one is less than about 10% of the other, its inertia may not be sufficient to provide the necessary torque to the other. Thus, the spin of the smaller body would quickly go to zero, and even reverse, with little effect on the spin of the other. Even with the same order of mass and inertia, if the ratios are different, then one body may despin to zero, or even reverse, before the spin of the other body is stopped. The final spin rate of a pair of bodies will be equal if the ratio of the inertia and the radius of action are the same for each body; i.e. if $$\frac{I_1}{r_1}=\frac{I_2}{r_2},$$

where $r_1$ and $r_2$ are the radii at which the strap acts on bodies 1 and 2 respectively.

Figure 17:
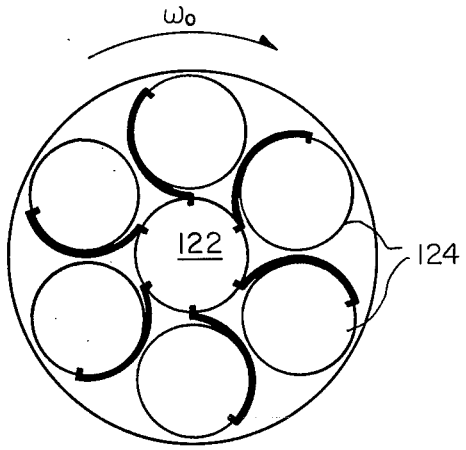
FIG. 17 is an illustration of yet another embodiment of the invention in which individual bodies are connected to a central body.

One embodiment of the feature of variable inertias is the case where several canisters or devices are attached to a larger central device as in FIG. 17. The energy in the central device 122 would be imparted to the smaller devices 124 as they separate from the central device and despin.

The despinning method here described has particular application to the release of two or more independently functional bodies. By merely connecting those bodies, despinning can be provided. No other masses for changing the moment of inertia of the system are required.

Figure 6:
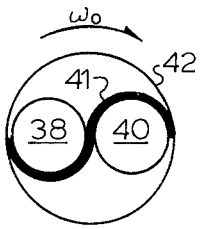
FIG. 6 shows an aggregate including only two bodies.
Figure 7:
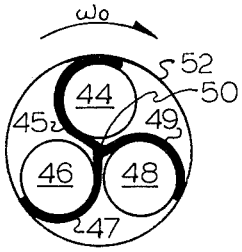
FIG. 7 illustrates an aggregate including three bodies.
Figure 8:
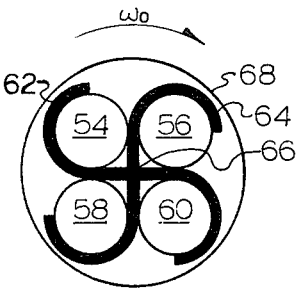
FIG. 8 is an illustration of four bodies in an aggregate.
Figure 9:
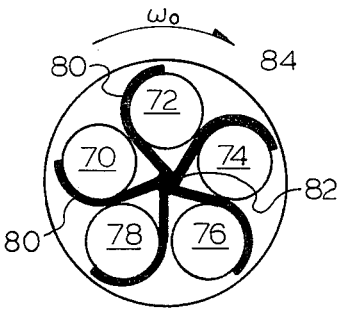
FIG. 9 is an illustration of five bodies in an aggregate.

Other canister arrangements in the aggregate are shown in FIGS. 6 thru 9. In FIG. 6, two canisters 38 and 40, joined by a connecting strap 41, are retained by holding means 42. In FIG. 7, three canisters, 44, 46, and 48, are joined by three straps 45, 47, and 49, which are joined at a center connector 50. All three canisters are held in the aggregate by a holding means 52. In FIG. 8, four canisters 54, 56, 58, and 60, are joined by straps 62 and 64 which pass through a center axis 66. The straps may or may not be joined along the axis 66. All canisters are retained in the aggregate by holding means 68. In FIG. 9, five canisters 70, 72, 74, 76, and 78, are joined by straps 80, all of which are joined at a center connector 82. All canisters are held together by a holding means 84 as before. Thus it can be seen any number of canisters can be held in the aggregate and be connected in such a way that, once released, the spin and translational movement of each applies torque to the others through the straps. In all cases the straps may be connected to a central structure as in FIG. 17 having finite inertia, in width case the structure may contribute to despinning and deployment of the canisters.

Figure 10A:
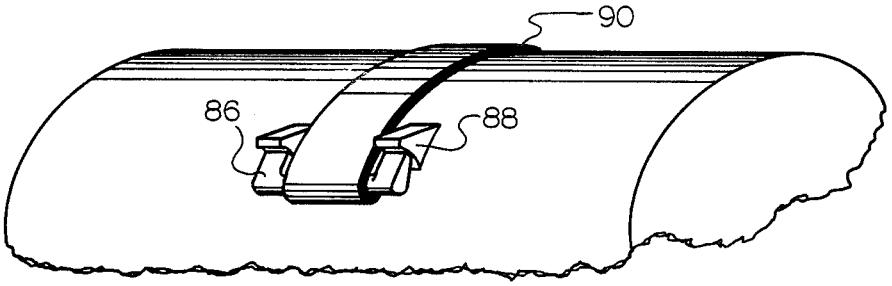
FIGS. 10A-C are illustrations of a strap release mechanism including a rigid link held against hooked pins.
Figure 10B:
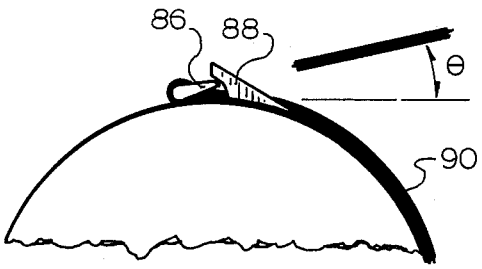
Figure 10C:
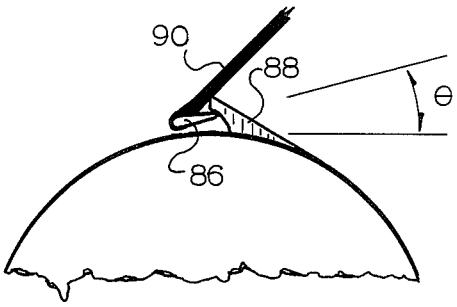

There are several ways to releasably connect the strap to each of the canisters. For example, in FIG. 10, a rigid link 86 is held against hooked pins 88 by a strap 90. When the strap passes an angle $\theta$ from the tangential line, it pulls the link loose from the hook and is automatically released.

Figure 11A:
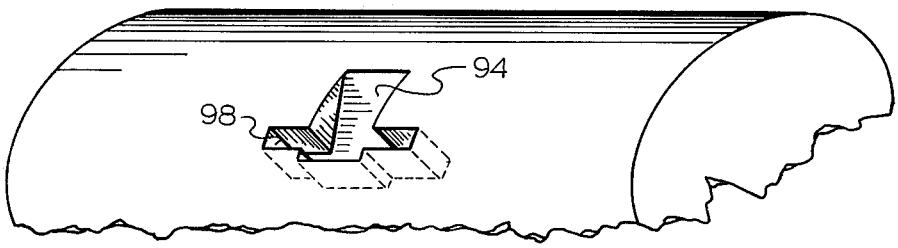
FIGS. 11A-C are illustrations of an alternative release mechanism including a cross pin held in a slot by the strap.
Figure 11C:
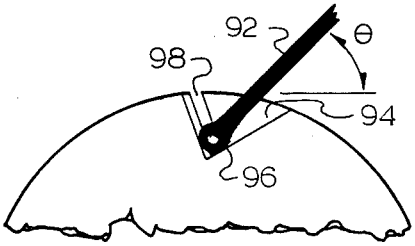
Figure 11B:
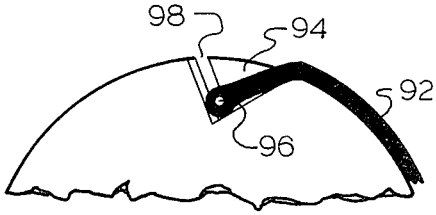

In FIG. 11 another release mechanism is shown. In that device the strap 92 extends into a groove 94 in the canister. It pulls on a pin 96 which extends across the slot 98. When the strap is positioned beyond an angle $\theta$ the pin slides out of the slot 98 to release the strap.

Figure 12:
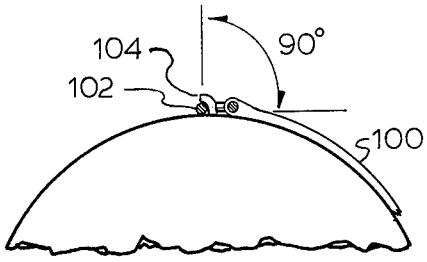
FIG. 12 is yet another release mechanism in which the strap is connected to a ring for radial release.

FIG. 12 shows an embodiment for radial release of the strap. A ring 102 at the end of the strap 100 is held by a hook 104. When the strap extends radially from the canister, it is able to slip off the hook 104.

Figure 13:
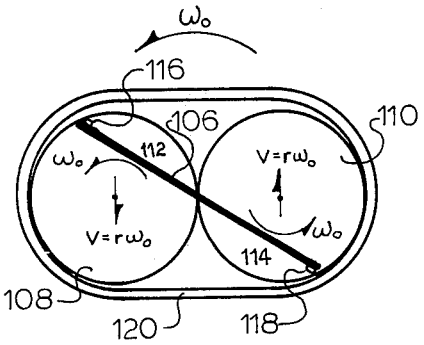
FIG. 13 is an illustration of an alternative embodiment in which a rigid connecting member joins two spinning bodies.

Thus far, an elongated flexible connecting member has been described. It should be recognized that one or more straps may be used. Further, as shown in FIGS. 13 thru 16, a rigid member may be used to apply the torque from each spinning body to the other. In FIG. 13, a rigid link 106 joins two canisters 108 and 110. The connecting link 106 is joined to the canisters by pins 116 and 118. As before, the canisters are held together by a holding means 120.

Figure 14:
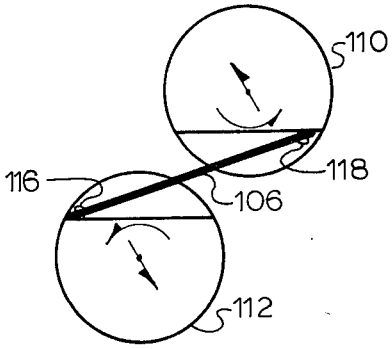
FIG. 14 is a view of the bodies of FIG. 13 after release from the aggregate with the connecting member in tension.

The aggregate of the two canisters spins at an initial angular velocity $\omega_o$, shown in the counterclockwise direction. Once the canisters are released, as shown in FIG. 14, they begin to move vertically in opposite directions. Also their spins are in opposition through the link 106. With the link thus in tension it holds back on the spin of each canister and adds a horizontal component to their translational movement as shown in FIG. 14. Thus as before, the spin of each canister can be reduced to zero or some other desired spin rate. As before, canisters of different sizes will provide different results, as will differences in the release mechanism and differences in the length of the connecting link.

Figure 15:
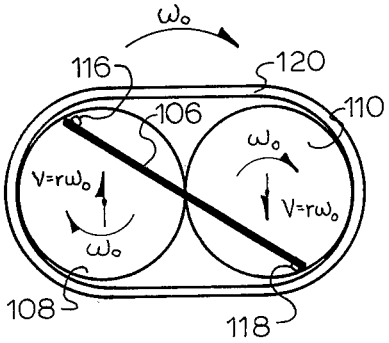
FIG. 15 is an illustration similar to FIG. 13, but showing a reverse spin.
Figure 16:
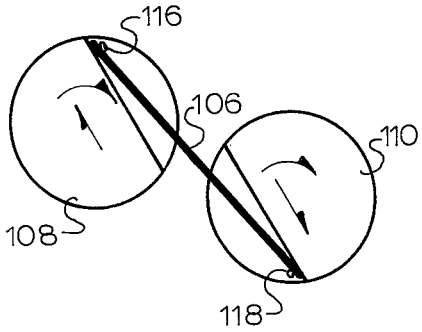
FIG. 16 is an illustration of the bodies of FIG. 15 after release from the aggregate with the connecting member in compression.

The system of FIG. 15 is identical to that of FIG. 13 except that the initial spin is in the opposite direction. As a result, when the canisters are released from the aggregate as shown in FIG. 16, the connecting link 106 is placed in compression by the opposing spins of the canisters. The link thus presses outwardly on the canisters against their spin to convert the spin to translational movement. As before, some passive device may be arranged to release the connecting link from both canisters to thus provide for proper de-spinning of the canisters.

Figure 18:
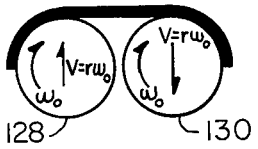
FIG. 18 illustrates an embodiment in which the spin of one body is increased and that of another is decreased.
Figure 19:
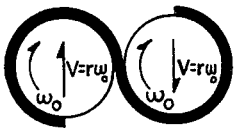
FIG. 19 illustrates a two-body configuration in which the spin of both bodies is increased.

FIGS. 18 and 19 show two configurations in which the angular velocity of at least one of the bodies may be increased. In FIG. 18 the strap 126 is connected such that the spins of the two bodies 128 and 130 are not in opposition. However, as the two bodies separate with opposite translational movement, torque is applied to each through the strap 126. That torque increases the spin rate of body 128, but decreases the spin rate of body 130.

In FIG. 19, the strap is attached so that as the bodies separate, their translational movement imparts a torque to each body to increase the spin rate of each at a loss of translational velocity.

While the invention has been particularly shown and described with reference to preferred embodiments thereof, it will be understood by those skilled in the art that various changes in form and details may be made therein without departing from the spirit and scope of the invention as defined by the appended claims.

I claim:

1. A method of changing the individual spins of at least two bodies released from a spinning aggregate comprising:

connecting the bodies with a connecting means;

causing the bodies to spin as an aggregate;

subsequently releasing the bodies simultaneously from the aggregate while remaining connected by said connecting means so that the motion of each body is simultaneously providing torque to the other body or bodies through the connecting means to thereby change the spin of the other body or bodies while still connected; and subsequently disconnecting the bodies from the connecting means.

2. A method of changing the individual spins of at least two bodies released from a spinning aggregate comprising:

connecting the two bodies with elongated, flexible connecting means with the connecting means wrapped about each of the bodies;

subsequently releasing the two bodies from the spinning aggregate with the motion of each body providing torque to the other body through the elongated, flexible connecting means to change the spin of the other element; and subsequently disconnecting the two bodies.

3. The method of claim 1 or 2 wherein the bodies are connected by the connecting means such that the spin of each is in opposition to the spin of the other through the connecting means.

4. The method of claim 1 or 2 wherein the two bodies have about the same moment of inertia and the spin of each is reduced to near zero.

5. The method of claim 1 or 2 wherein the spins of more than two bodies released from the aggregate are similarly changed.

6. The method of claim 5 wherein the more than two bodies in the aggregate are joined by elongated, flexible connecting elements which intersect a common axis.

7. The method of claim 6 wherein the elongated flexible elements are joined at the common axis.

8. A method of claim 1 or 2 wherein the bodies are disconnected by disconnecting each from the connecting means.

9. The method of claim 1 or 2 wherein the connecting means includes at least one strap.

10. An aggregate of bodies, the bodies to be released as individual projectiles from the spinning aggregate, comprising:

at least two bodies;

self-disconnecting connecting means attached to each body and extending in other than a radial direction from each body in order to apply torque to each body when released from a spinning aggregate to change the spin of each body in a controlled manner while the bodies are connected by the connecting means; and holding means for releasably holding the bodies fixed relative to each other in the aggregate with spinning of the aggregate.

11. An aggregate of bodies to be released as individual projectiles from the spinning aggregate comprising:

at least two bodies;

disconnectable, elongated, flexible connecting means attached to each body and wrapped circumferentially about each body to oppose the spin of each once released from the aggregate; and holding means for releasably holding the bodies fixed relative to each other in the aggregate with spinning of the aggregate.

12. An aggregate of bodies as claimed in claim 10 or 11 wherein the bodies have about the same mass and the connecting means is disconnectable at an orientation relative to the bodies at which the spin of the bodies is near zero after bgeing released from the holding means.

13. An aggregate of bodies as claimed in claim 10 or 11 including more than two bodies similarly attached to the disconnectable connecting means.

14. An aggregate of bodies as claimed in claim 13 wherein the more than two bodies have about the same moment of inertia and are joined by elongated, flexible connecting elements which intersect a common axis.

15. An aggregate of bodies as claimed in claim 14 wherein the elongated, flexible connecting elements are joined at the common axis.

16. An aggregate of bodies as claimed in claim 10 or 11 wherein the connecting means is disconnectable at each end thereof.

17. An aggregate of bodies as claimed in claim 10 or 11 wherein the connecting means is at least one strap.

18. An aggregate of bodies as claimed in claim 10 or 11 wherein the moments of inertia of the bodies are of the same order of magnitude.

* * * * *

UNITED STATES PATENT AND TRADEMARK OFFICE

CERTIFICATE OF CORRECTION

PATENT NO. : 4,264,045

DATED : April 28, 1981

INVENTOR(S) : Robert J. Campbell

It is certified that error appears in the above-identified patent and that said Letters Patent are hereby corrected as shown below:

Column 1, line 27, please change "to" to ---of---.

Column 4, line 46, please change "width" to ---which---.

Signed and Sealed this

*Twenty-first* Day of *July 1981*

[SEAL]

*Attest:*

GERALD J. MOSSINGHOFF

*Attesting Officer*

*Commissioner of Patents and Trademarks*